US008376187B2

(12) United States Patent
Keller

(10) Patent No.: US 8,376,187 B2
(45) Date of Patent: Feb. 19, 2013

(54) DISPENSING ASSEMBLY HAVING REMOVABLY ATTACHABLE ACCESSORIES

(75) Inventor: Wilhelm A. Keller, Merlischachen (CH)

(73) Assignee: Sulzer Mixpac AG, Haag (CH)

( * ) Notice: Subject to any disclaimer, the term of this patent is extended or adjusted under 35 U.S.C. 154(b) by 679 days.

(21) Appl. No.: 12/530,873

(22) PCT Filed: Mar. 17, 2008

(86) PCT No.: PCT/CH2008/000110

§ 371 (c)(1),
(2), (4) Date: Sep. 11, 2009

(87) PCT Pub. No.: WO2008/113196

PCT Pub. Date: Sep. 25, 2008

(65) Prior Publication Data

US 2010/0102088 A1 Apr. 29, 2010

(30) Foreign Application Priority Data

Mar. 19, 2007 (CH) ..... 0433/07

(51) Int. Cl.
*B67D 7/70* (2010.01)

(52) U.S. Cl. ..... 222/137; 222/145.6

(58) Field of Classification Search ..... 222/137, 222/145.5, 145.6, 145.1, 567; 215/318
See application file for complete search history.

(56) References Cited

U.S. PATENT DOCUMENTS

| | | | | |
|---|---|---|---|---|
| 5,544,778 | A * | 8/1996 | Goncalves | 220/23.4 |
| 5,702,017 | A * | 12/1997 | Goncalves | 220/23.4 |
| 5,918,772 | A * | 7/1999 | Keller et al. | 222/145.6 |
| 6,820,766 | B2 * | 11/2004 | Keller et al. | 222/137 |
| 7,556,618 | B2 * | 7/2009 | Sogaro | 604/191 |
| 7,631,782 | B2 * | 12/2009 | Engelbrecht et al. | 222/145.6 |
| 7,694,853 | B2 * | 4/2010 | Keller | 222/137 |
| 7,874,458 | B2 * | 1/2011 | Sogaro | 222/137 |
| 2006/0014440 | A1 * | 1/2006 | Sogaro | 439/652 |

FOREIGN PATENT DOCUMENTS

| | | | |
|---|---|---|---|
| DE | 297 09 383 | U1 | 10/1998 |
| EP | 0 730 913 | A1 | 9/1996 |
| EP | 1 724 208 | A1 | 11/2006 |
| WO | WO 2005/075312 | A1 | 8/2005 |
| WO | WO 2006/005206 | A1 | 1/2006 |

* cited by examiner

*Primary Examiner* — Kevin P Shaver
*Assistant Examiner* — Daniel R Shearer
(74) *Attorney, Agent, or Firm* — Kilpatrick Townsend & Stockton LLP

(57) ABSTRACT

The dispensing assembly includes a cartridge having at least two containers and accessories. The fastening area (6) of the cartridge (1) and the fastening areas (9) of the accessories (4) are configured such that the accessories are attachable to the cartridge by plugging them on without a twisting motion and removable therefrom by twisting them one relative to another. In a further developed embodiment, the parts comprise coding elements which serve as aligning means and for preventing that the accessory is plugged onto the cartridge in the wrong orientation. An assembly of this kind allows an easy attachment and removal of an accessory such as a mixer or a closure cap and can be produced inexpensively.

15 Claims, 7 Drawing Sheets

DISPENSING ASSEMBLY HAVING REMOVABLY ATTACHABLE ACCESSORIES

CROSS-REFERENCE TO RELATED APPLICATIONS

This application is a National Stage of International Application No. PCT/CH2008/000110, filed Mar. 17, 2008 and which claims the benefit of Swiss Patent Application No. 433/07, filed Mar. 19, 2007, the disclosures of all applications being incorporated herein by reference.

The present invention relates to a dispensing assembly including a cartridge or syringe having at least one container and accessories, according to the preamble of claim 1.

WO 2005/075312 A1 discloses such a dispensing assembly with a single container having a dispensing nozzle and a cap, whereby the external surface of the nozzle is provided with ramps and retaining means and the internal surface of the cap is provided with cooperating retaining means. In one embodiment the retaining means are snap-fit means to enable to snap the cap onto the nozzle and to disengage it by twisting the cap relatively to the nozzle.

However, a large number of cartridges, double cartridges or syringes or double syringes are known in the art to which further accessories such as mixers, double closure caps, dispensing tips, spray nozzles, or adapters are connected for dispensing.

Generally, two kinds of fastening means are known in the art for double or multiple cartridges or syringes, namely fastening members of the bayonet type such as disclosed in EP 0 730 913 A1, on one hand, and fastening members with a threaded ring such as disclosed in U.S. Pat. No. 5,228,599 A, on the other hand. These fastening means have in common that the fastening members are either relatively demanding to manufacture or, if an additional part is present, the attachment and removal of the members may be complicated.

On this background, it is the object of the present invention to provide a dispensing assembly including a cartridge or syringe having at least two containers where the accessories like mixers, double closure caps, dispensing tips, spray nozzles, or adapters are simply attachable or removable and whose manufacturing costs are lower than in conventional assemblies. This is accomplished by the dispensing assembly according to claim 1.

Another object of the invention is to provide a dispensing assembly in which it is ensured that the accessories are attached in the correct orientation or prevented that unsuitable accessories are connected. This is accomplished by the dispensing assembly as defined in claim 11.

Hereinafter, the term "cartridge" is meant to designate a double or multiple cartridge or a double or multiple syringe. Two-part multiple cartridges or syringes as well as double cartridges having a concentric arrangement of the containers or a cylindrical container having a separating wall are also encompassed by the above term "double cartridge".

The invention will be explained in more detail hereinafter with reference to drawings of exemplary embodiments.

Figure 1:
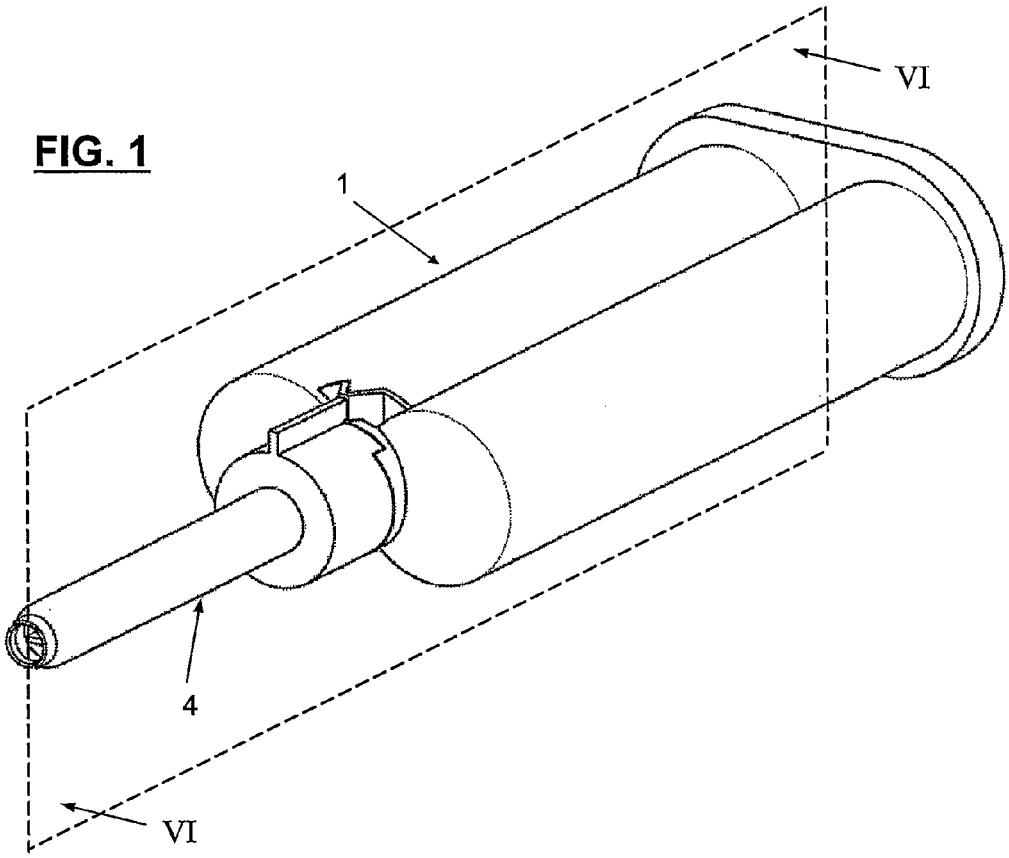
Figure 2:
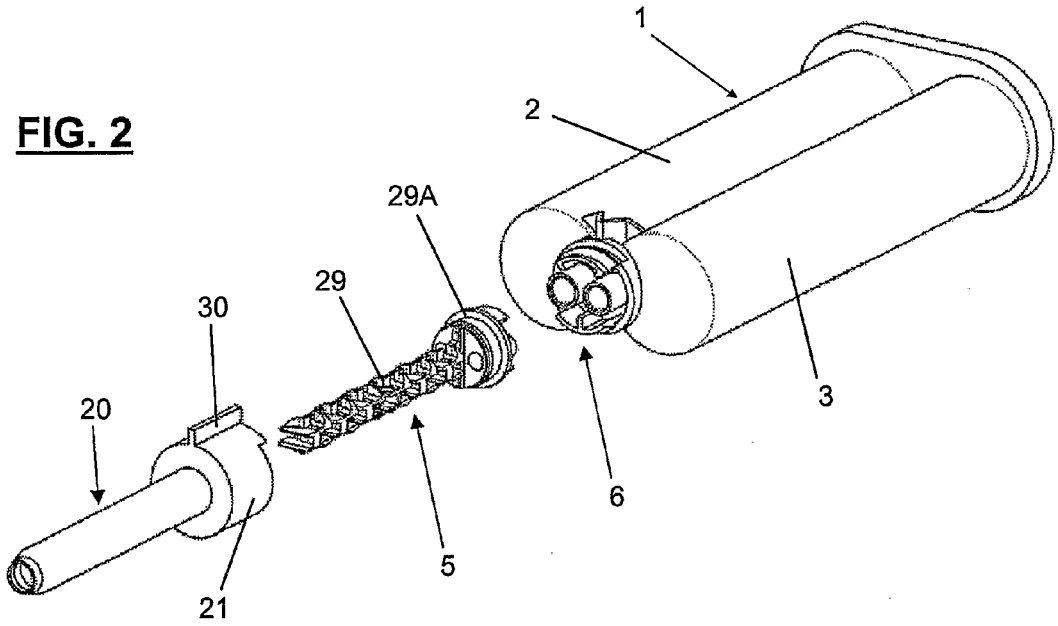
Figure 3:
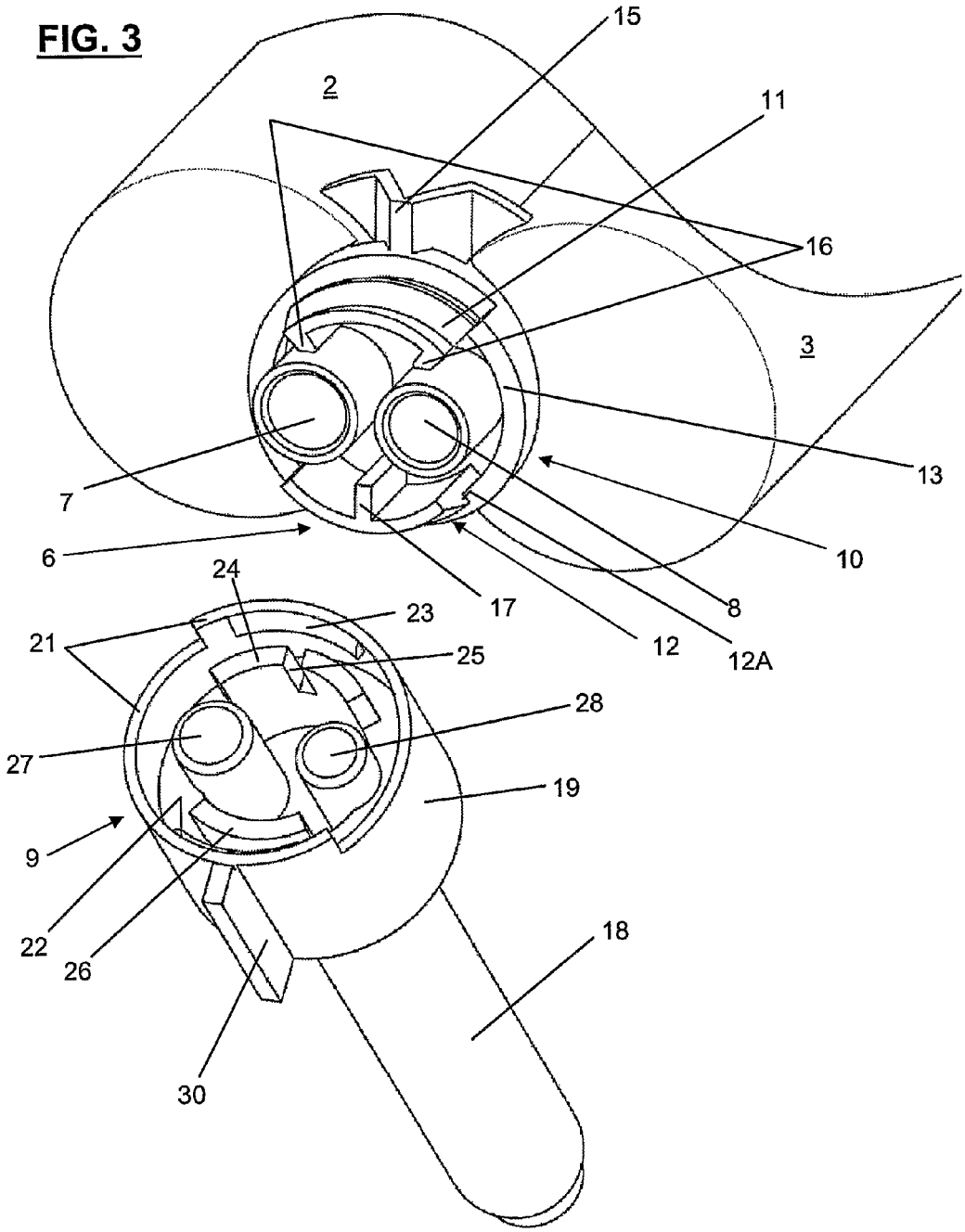
Figure 4:
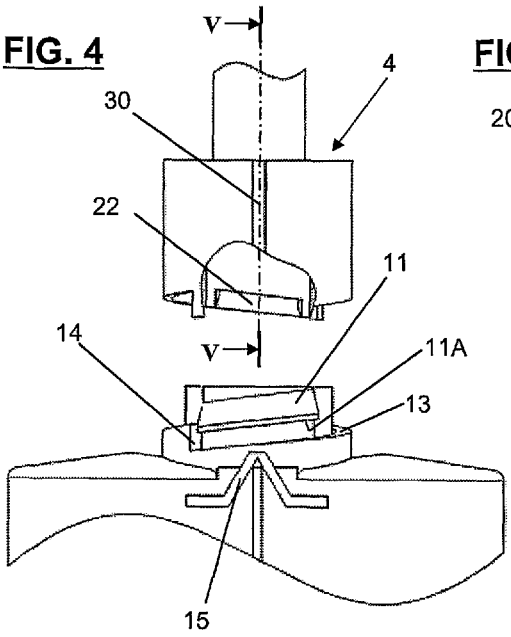
Figure 5:
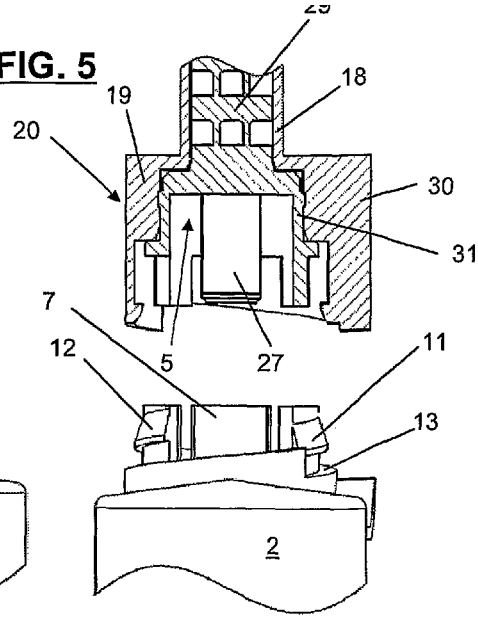
Figure 6:
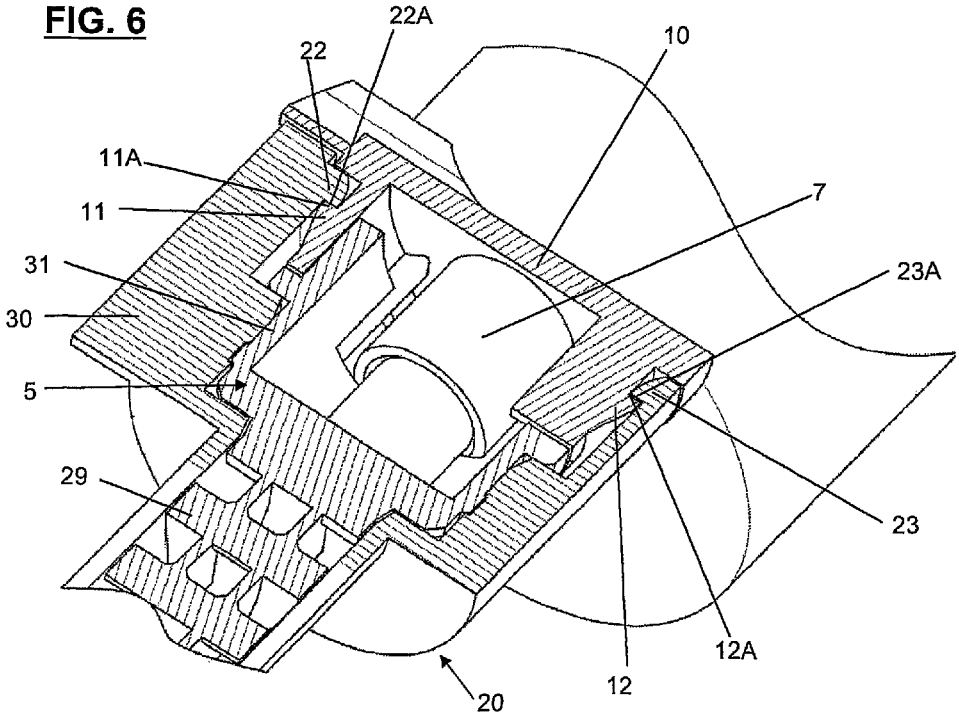
Figure 7A:
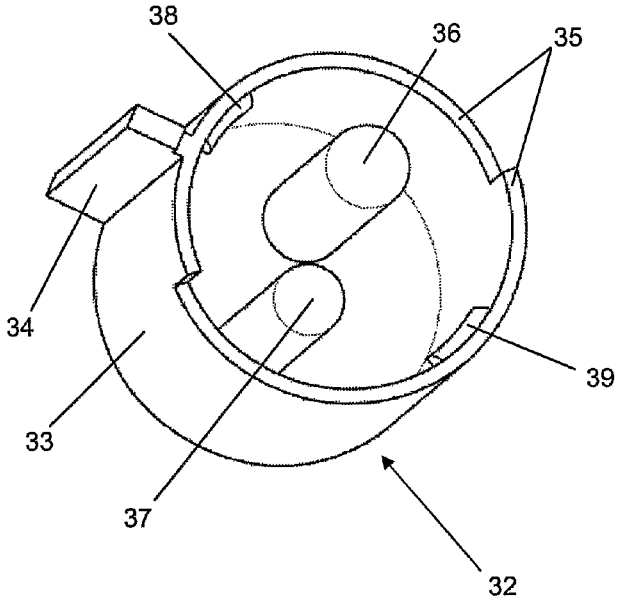
Figure 7B:
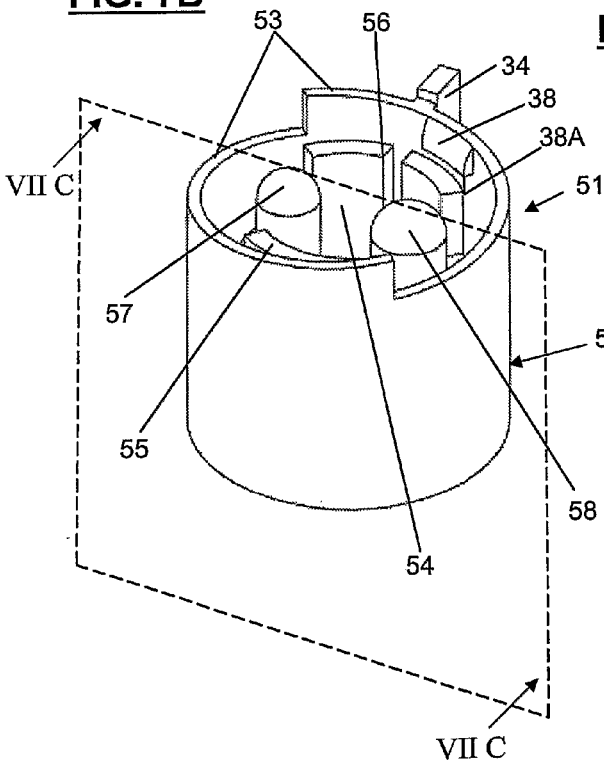
Figure 7C:
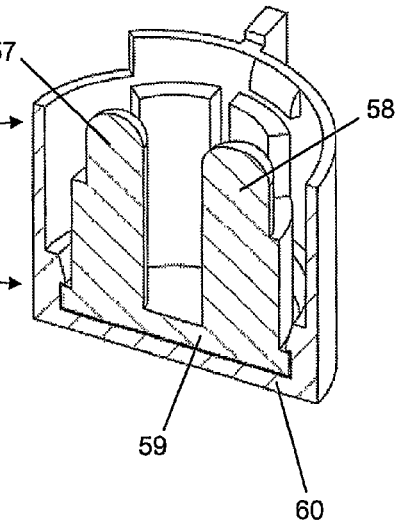
Figure 8:
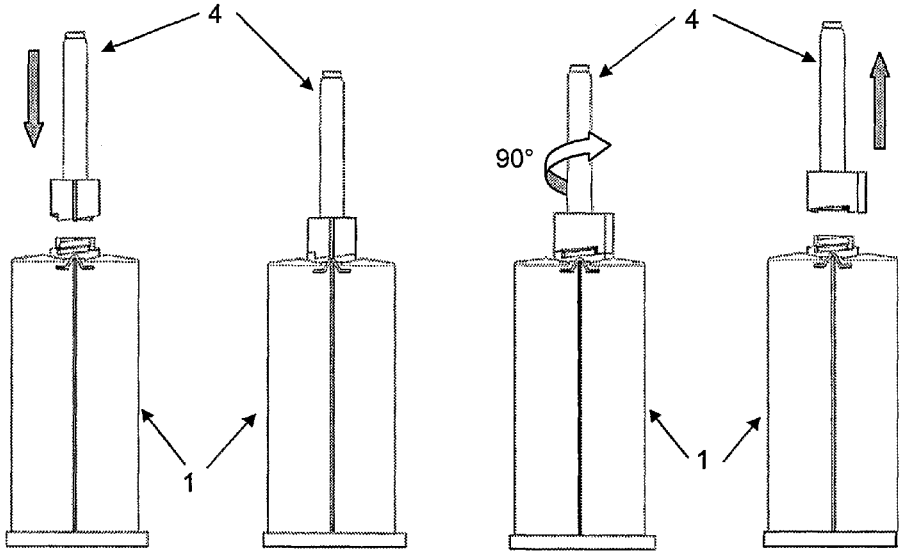
Figure 10:
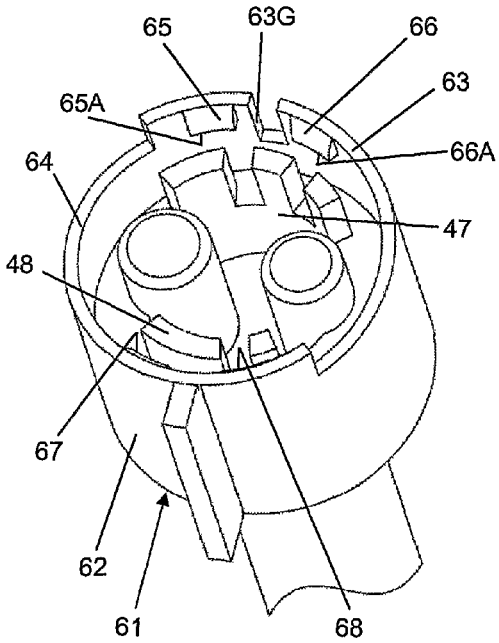
Figure 11:
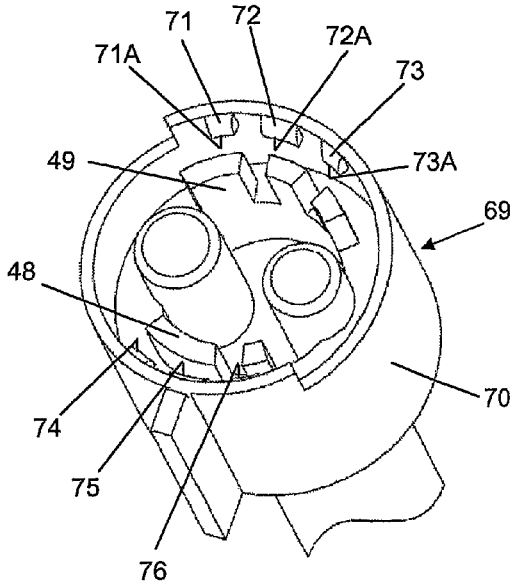
Figure 9:
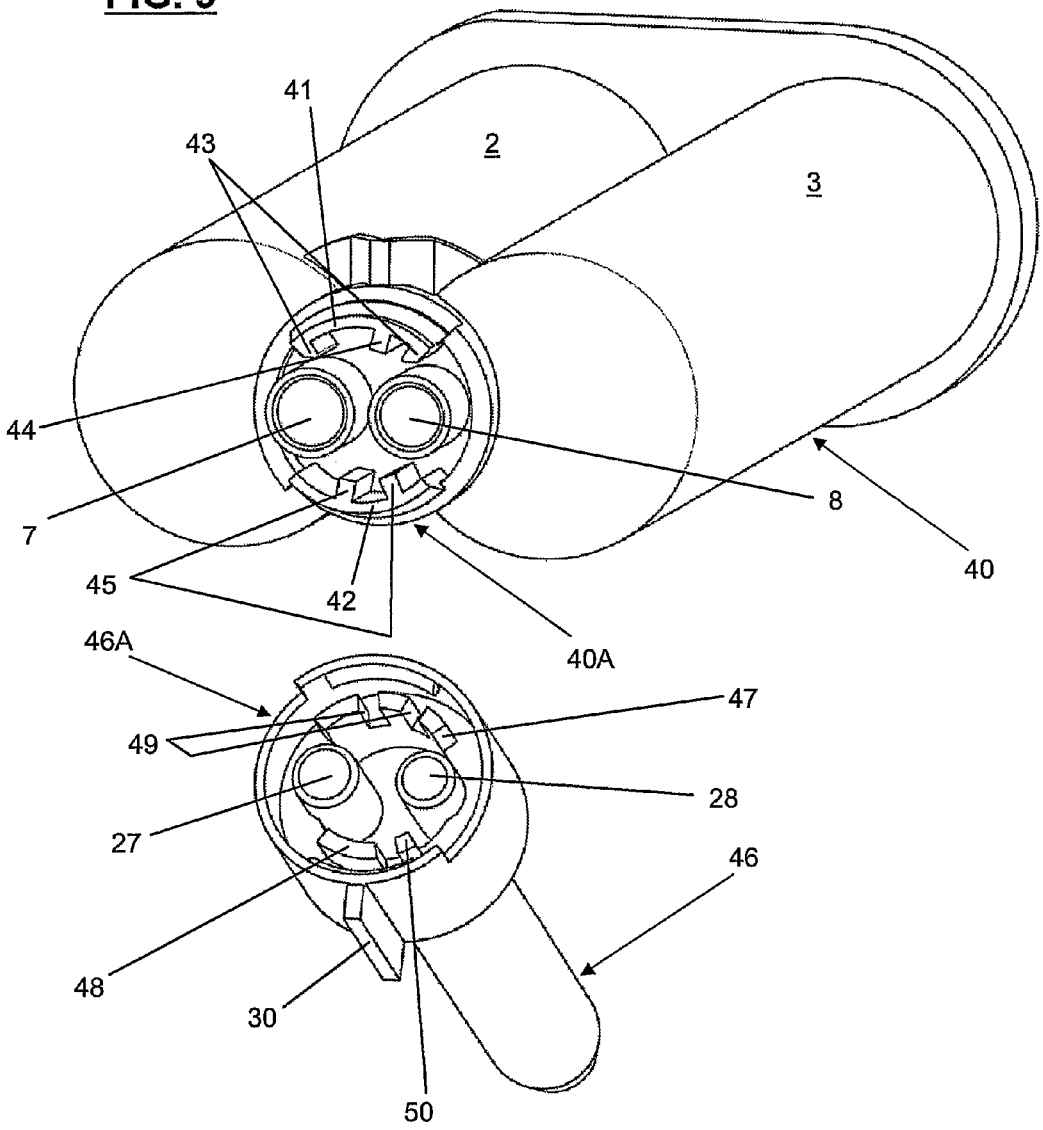
Figure 12:
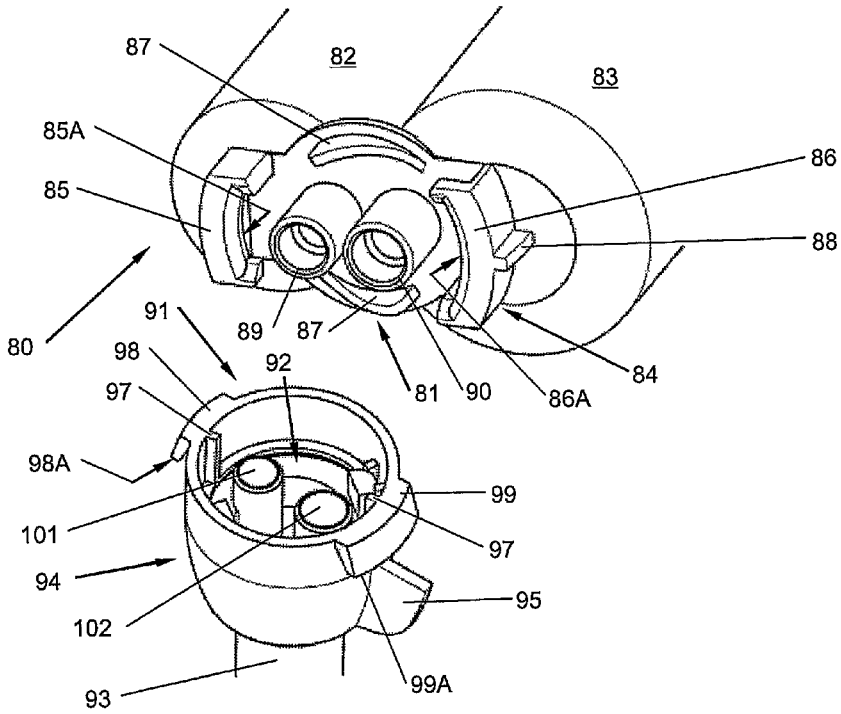
Figure 13:
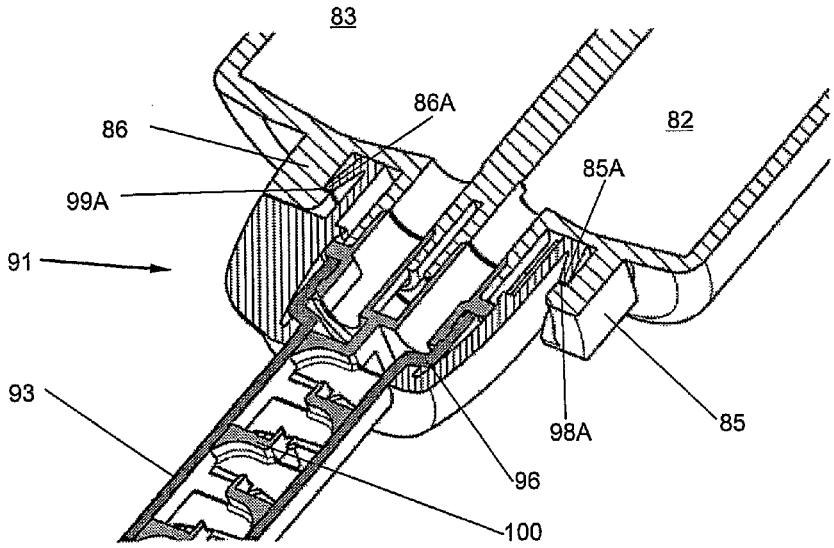

FIG. 1 shows a perspective view of a first exemplary embodiment of a cartridge according to the invention with an attached mixer, FIG. 2 shows the cartridge and the mixer of FIG. 1 individually, FIG. 3 shows an enlarged detail of the fastening areas of the cartridge and of the mixer of FIG. 2, FIG. 4 shows an enlarged detail of the external parts of the fastening areas of the cartridge and the mixer of FIG. 2, FIG. 5 shows a longitudinal section according to plane V-V in FIG. 4, FIG. 6 shows an enlarged detail of a section according to plane VI-VI in FIG. 1, FIG. 7A shows a perspective view of a one-piece closure cap having pliable closure plugs, FIG. 7B shows a perspective view of a closure cap having rotatable closure plugs, FIG. 7C shows a section according to plane VIIC-VIIC in FIG. 7B, FIG. 8 shows a schematic sequence of the attachment of the mixer to a cartridge and its removal, FIG. 9 shows a variant of the exemplary embodiment according to FIG. 3, FIGS. 10 and 11 show two embodiment variants of the mixer according to FIG. 9, FIG. 12 shows an enlarged detail of the fastening areas of the cartridge and of the mixer of a further exemplary embodiment, showing inversed retaining means at both parts, FIG. 13 shows in analogy to FIG. 6 an enlarged detail of a section of the assembled parts of FIG. 12.

FIGS. 1 and 2 illustrate a double cartridge 1 having two containers 2 and 3 and to which a mixer 4 is fastened.

In FIG. 2, fastening area 6 of the cartridge is shown which comprises the two outlets 7 and 8, outlet 7 having a larger diameter than outlet 8 in the present case for coding purposes whereas the two containers 2 and 3 may have equal or different diameters and volumes, respectively. Alternatively, the outlets may also have equal diameters. Of mixer 4, housing 20 with mixer tube 18 and the fastening portion with visual coding member 30 as well as inner part 5 of the mixer with mixing elements 29 and the inlets in inlet portion 29A is shown.

In FIG. 3, fastening area 6 of the cartridge is shown on an enlarged scale. Attachment socket 10 has two retaining segments 11 and 12 whose cross-section is shown in FIG. 6, two lift-off ramps 13 and a rotational stop 14 at the junction between retaining segment 11 and a lift-off ramp 13. At least the respective retaining surfaces 11A, 12A of the retaining segments are parallel to the corresponding lift-off ramps, i.e. have the same gradient as the latter, see FIG. 4.

Both the retaining segments respectively the snap segments and the lift-off ramps may be continuous or segmented. The gradient angle of the lift-off ramps as well as of the retaining surfaces of the retaining segments and of the engagement surfaces of the snap segments is within a range of about 1° to 30°, preferably 3°-10°. The fastening area further comprises a visual coding member 15 that is e.g. V-shaped here.

On the inner side of the retaining segments, the inner coding means are arranged. In the present example, these inner coding means consist of a volume ratio coding and a mixer type coding. Thus, the interior of retaining segment 11 is limited by two coding webs 16. Between them, any combination of coding webs may be arranged, see FIG. 9. Coding webs are also arranged on the inner side near retaining segment 12, e.g. coding web 17. As mentioned before, the different diameters of the cartridge outlets and of the mixer inlets, respectively, may also constitute a coding means.

In FIG. 3, the fastening area 9 of mixer 4 is illustrated on an enlarged scale, and mixer tube 18 is visible here. Mixer coupling portion 19 is externally provided with a visual coding member 30 in the form of a ridge that can be aligned to visual coding member 15 on the cartridge prior to its attachment. On its front side, mixer coupling portion 19 has two lift-off ramps 21 that correspond to lift-off ramps 13 on the cartridge. On the inside of the coupling portion, two snap segments 22 and 23 are provided whose engagement surfaces 22A, 23A engage behind retaining surfaces 11A and 12A of retaining segments 11 and 12 on the cartridge, see also FIG. 5.

At least the engagement surfaces 22A, 23A of the snap segments are also parallel to the corresponding lift-off ramps, see FIG. 4, and both the snap segments and the lift-off ramps may be continuous or segmented.

Mixer coupling portion 19 and mixer tube 18 form mixer housing 20 that is arranged rotatably with respect to the inner part 5 of the mixer including the mixing elements, inlets, and inner coding segments. In certain embodiments, it may be advantageous to provide the possibility that the mixing elements can be sheared off from inlet portion 29A when the mixer is twisted off.

In the mixer inlet area, an inner coding segment 24 is arranged that has at least one coding slot 25 which corresponds to coding web 17 on the cartridge. Opposite coding segment 24, another coding segment 26 is arranged whose segment length corresponds to the distance between the coding webs 16 on the cartridge. In order to prevent that the mixer may be attached when rotated by 180°, coding segment 24 is longer than the distance between coding webs 16. The two inlets 27 and 28 of the mixer have different diameters too, inlet 27 having a larger diameter than inlet 28, and these inlets corresponding to outlets 7 and 8 of the cartridge. In the mixer also, the inlets may alternatively have equal diameters.

In FIG. 4 and partly 5, the exterior of the fastening areas is shown, i.e. mixer coupling portion 19 and a snap segment 22 and on the cartridge, retaining segments 11 and 12, lift-off ramps 13 and stop 14, as well as the visual coding members 15 and 30.

FIG. 5 is a sectional view according to plane V-V in FIG. 4 that shows the inner cylinder wall 31 of the mixer inlet, in which inner part 5 of the mixer is snapped in so as to be secured in the axial direction but maintained rotatably with respect to this wall and thus with respect to mixer housing 20.

The sectional view of FIG. 6 shows the elements that have been described above, in particular snap segments 22 and 23 with engagement surfaces 22A, 23A engaging behind retaining surfaces 11A and 12A of retaining segments 11 and 12.

In FIG. 7A, a simple, one-piece embodiment of a closure cap 32 is depicted in a perspective view. Cap housing 33 has a visual coding member 34 and on its open front side two lift-off ramps 35. In analogy to the outlets of the cartridge, the two closure plugs 36 and 37 have different diameters and are made from a pliable plastics material. The two snap segments 38 and 39 are shorter than those of the mixer and therefore require a smaller twisting angle for withdrawal.

In the same way as the mixer, the closure cap is visually aligned and pressed onto the cartridge until the snap segments engage behind the retaining segments. Its removal only requires a small twist to disengage the snap segments. Since the closure plugs are pliable, they are bent and pulled out of the outlets of the cartridge as the cap is twisted off.

It is also possible to provide the closure cap with closure plugs that are rotatably arranged in the cap housing. FIGS. 7B and 7C show a closure cap 51 having a cap housing 52 provided with the two lift-off ramps 53, visual coding member 34, snap segment 38 and invisible snap segment 39 with engagement surfaces 38A and 39A, as well as coding segments 54 and 55, coding segment 54 having a coding slot 56.

The sectional view 7C according to plane VIIC-VIIC in FIG. 7B shows the two closure plugs 57 and 58, which are arranged on a base 59 that is snapped in at the bottom 60 of the cap housing and rotatable with respect to the bottom.

From the foregoing description of the parts, the attachment and removal of the mixer or analogously of the closure cap as it is schematically depicted in FIG. 8 becomes apparent:

In order to attach the mixer in the correct orientation, the mixer is first aligned by means of the visual coding members 15 and 30. In this position, the mixer can then be pushed onto the cartridge according to FIG. 4 while the snap segments slide on the retaining segments to engage behind the retaining surfaces of the retaining segments at the end of the movement, thereby attaining the position of FIG. 5. During the connection of the two parts, coding web 17 engages in coding slot 25, thereby ensuring an additional guidance of the mixer. As follows from the foregoing, if it is attempted to attach the mixer rotated by 180°, the latter cannot be pushed in.

For its withdrawal, the mixer is twisted in the counterclockwise direction, whereby the snap segments slide out of the retaining segments and the mixer can be drawn off. During twisting, the lift-off ramps slide on one another and cause the mixer to be lift-off from the cartridge in the longitudinal axis so that the mixer inlets are pulled out of the cartridge outlets.

It is clearly apparent from the description of the retracting operation why mixer housing 20 together with the mixer coupling portion must be twistable with respect to the mixer inlets and the coding segments. In the present exemplary embodiment, the entire mixer housing, i.e. the mixer coupling portion with the snap segments and the mixer tube is twistable with respect to inner part 5 including the coding segments, inlets, and the mixing element.

It is also possible to make the mixer housing twistable with respect to mixer inlet portion 29A with the coding segments only, the mixing element being fixed inside the mixer tube and the latter being sheared off from the mixer inlet portion due to the twisting movement.

FIG. 9 illustrates a variant of the possibilities of an inner coding. Double cartridge 40 with the two containers 2 and 3 and outlets 7 and 8 has two opposed coding segments 41 and 42 with coding webs on the inside of its fastening area 40A. Coding segment 41 has two end coding webs 43 as well as an intermediate coding web 44, whereas coding segment 42 has two coding webs 45 arranged in its central area.

In the interior of its fastening area 46A, mixer 46 has corresponding coding segments 47 and 48, coding segment 47 having two coding slots 49 and coding segment 48 one coding slot 50. This arrangement allows a large number of coding possibilities.

FIG. 10 shows an attachment variant of the mixer of FIG. 9. Mixer 61 has a housing 62 whose lift-off ramps 63 and 64 are not continuous. Thus, lift-off ramp 63 has a gap 63G or alternatively a plurality of gaps. Instead of a single snap segment on one side, two snap segments 65 and 66 as well as 67 and 68 with the corresponding engagement surfaces 65A-68A may be provided. The inner coding segments and coding webs as well as the inlets are designed according to FIG. 9.

As a variant of the mixer of FIG. 10, mixer 69 with housing 70 of FIG. 11 has respective sets of three snap segments 71, 72, 73 and 74, 75, 76 with the corresponding engagement surfaces 71A-76A. The remaining elements are the same as in the mixer according to FIG. 9. On this basis, many variations in the design of the ramps and snap segments are possible.

If the accessory is in the form of an adapter, one end thereof is provided with a cartridge fastening area 6 or 40A and the other end with an accessory fastening area 9 or 46A.

FIGS. 12 and 13 show a further exemplary embodiment, where the retaining means are inverted and simplified and the lift-off means also simplified with regard to the previously disclosed embodiments. FIG. 12 is analogous to FIG. 3 and FIG. 13 is analogous to FIG. 6, thus the differences are easily explained by comparing these two pairs of Figures.

FIG. 12 shows fastening area 81 of cartridge 80 with the two containers 82, 83 on an enlarged scale. Attachment socket 84 has two retaining segments 85 and 86 whose cross-section is shown in FIG. 13, and two lift-off ramps 87. These lift-off ramps are shorter but steeper than the previously shown and have a gradient of about 20° to 35°, preferably about 25° to 33°. The fastening area further comprises a visual coding member 88 that is e.g. V-shaped here.

In this embodiment, the inner coding means consists of the different length of the retaining segments, whereby retaining segment 85 is shorter as retaining segment 86. A further coding means are the different diameters of the outlets 89 and 90.

In difference to the embodiment of FIG. 3 the retaining surfaces 85A and 86A are situated on the inner side of the retaining segments as follows from FIG. 13. For facilitating the snapping on of the accessory, the inner upper surfaces 85B and 86B of the retaining segments are inclined.

Mixer 91 comprises a fastening area 92, a mixer tube 93 and a mixer coupling portion 94 which is externally provided with a visual coding member 95 in the form of a ridge that can be aligned to visual coding member 88 on the cartridge prior to its attachment. Within the mixer housing 96 and flush with its front surface two lift-off ribs 97 are provided that cooperate with the lift-off ramps 87 on the cartridge.

In difference to the embodiment of FIG. 3 the two snap segments 98 and 99 are arranged on the outside of the coupling portion 94 and whose engagement surfaces 98A and 99A engage behind retaining surfaces 85A and 86A of retaining segments 85 and 86 on the cartridge, see FIG. 13.

Due to the relatively shortness of the retaining and snap segments and of the lift-off ribs those parts can be arranged essentially parallel to the front surfaces of the cartridge and accessory, since for disengaging the accessory from the cartridge first the retaining and snap segments disengaged and than the lift-off ribs begin to slide on the lift-off ramps of the cartridge for lifting off the accessory.

Mixer coupling portion 94 and mixer tube 93 form mixer housing 96 that is arranged rotatably with respect to the inner part 100 of the mixer including the mixing elements, inlets, and inner coding segments. In certain embodiments, it may be advantageous to provide the possibility that the mixing elements can be sheared off from the inlet portion when the mixer is twisted off.

The two snap segments have different length, corresponding to the different length of retaining segments 85, 86. The two inlets 101 and 102 of the mixer have different diameters too, inlet 101 having a larger diameter than inlet 102, and these inlets corresponding to outlets 89 and 90 of the cartridge. In the mixer also, the inlets may alternatively have equal diameters. The procedure for fastening the accessory to the cartridge is the same for this embodiment as disclosed above.

The invention claimed is:

1. Dispensing assembly, including a cartridge or syringe having at least one container and an accessory, where the cartridge or syringe, on one hand, and the accessory, on the other hand, each have a respective fastening area, whereby the fastening area (6, 40A, 81) of the cartridge (1, 40, 80) or syringe and the fastening area (9, 46A, 92) of the accessory (4, 46, 61, 69; 32, 51; 91) are complementarily configured in such a manner that the accessory is attachable to the cartridge or syringe by plugging the accessory onto the cartridge or syringe without a twisting motion and removable therefrom by twisting the accessory relative to the cartridge or syringe, characterised in that the cartridge or syringe comprises at least two containers with one outlet (7, 8; 89, 90) each and the fastening area of the cartridge or syringe has retaining segments (11, 12; 85, 86) that are arranged on an attachment socket (10; 84); the cartridge or syringe including a lift-off ramp (13; 63; 35; 87) and the accessory including at least one of a lift-off ramp (21; 64; 53); the at least one of a lift-off ramp of the accessory being configured to interface with the cartridge or syringe lift-off ramp; the fastening area of the accessory having snap segments (22, 23; 65, 66, 71, 73; 38, 39; 98, 99) corresponding to the retaining segments of the cartridge or syringe; the snap segments having engagement surfaces (22A, 23A; 65A, 66A, 71A, 72A, 73A; 38A, 39A; 98A, 99A) configured to engage behind retaining surfaces (11A, 12A; 85A, 86A) of the retaining segments; a gradient angle of the cartridge or syringe lift-off ramp, of the retaining surfaces of the retaining segments, and of the engagement surfaces of the snap segments is within a range of 1° to 30°.

2. Dispensing assembly according to claim 1, characterised in that the retaining surfaces (11A, 12A) are arranged on the outer surface of the retaining segments (11, 12) at the cartridge or syringe and the engagement surfaces (22A, 23A; 65A, 66A, 71A, 71A, 73A; 38A, 39A) are arranged on the inner surface of the snap segments (22, 23; 65, 66, 71, 71, 73; 38, 39) at the accessory (20, 32).

3. Dispensing assembly according to claim 1, characterised in that the retaining surfaces (85A, 86A) are arranged within the attachment socket and the engagement surfaces (98A, 99A) are arranged on an exterior region of a coupling portion of the accessory (91).

4. Dispensing assembly according to claim 1, characterised in that the gradient angle is within a range of 3° to 10°.

5. Dispensing assembly according to claim 1, characterised in that the gradient angle of the lift-off ramps (87) of the retaining segments (85, 86) is within a range of 20° to 35°.

6. Dispensing assembly according to claim 1, characterised in that the retaining surfaces (11A, 12A) of the retaining segments (11, 12) and the engagement surfaces (22A, 23A, 65A, 66A, 71A, 71A, 73A; 38A, 39A) of the snap segments (22, 23, 38, 39) are arranged substantially parallel to the lift-off ramps.

7. Dispensing assembly according to claim 1, characterised in that the retaining segments, snap segments, and lift-off ramps are segmented.

8. Dispensing assembly according to claim 1, characterised in that the cartridge or syringe and the accessory have visual coding means (15; 30; 34; 88, 95) for aligning the accessory with the cartridge or syringe.

9. Dispensing assembly according to claim 1, characterised in that the cartridge or syringe and the accessory have coding elements (7, 8; 27, 28; 36, 37; 16, 17; 24-26; 41-45; 47-50; 89, 90; 101, 102) in order to prevent an attachment of the accessory to the cartridge or syringe in the wrong orientation or an attachment of an unsuitable accessory.

10. Dispensing assembly according to claim 9, characterised in that the coding elements of the cartridge or syringe include coding segments (41, 42) and coding webs (16, 17; 43-45) that are arranged within the attachment socket (10), and corresponding coding segments (24, 26, 47, 48, 54, 55) and at least one coding slot (25, 49, 50, 56) on the accessory (4, 46, 61, 69; 51).

11. Dispensing assembly according to claim 9, characterised in that the coding elements of the cartridge or syringe include outlets (7, 8; 89, 90) of different diameters and those of the accessory include inlets (27, 28; 101, 102) or closure plugs (36, 37; 57, 58) of corresponding different diameters.

12. Dispensing assembly according to claim 1, characterised in that the accessory is a mixer (4, 46, 61, 69, 91) that includes a housing (20, 62, 70, 96) of the mixer, the housing including the snap segments (22, 23; 65, 66, 71, 71, 73; 98, 99) and rotatable about at least one of an inner part (5, 100) of the mixer or an inlet portion (29A) of the mixer.

13. Dispensing assembly according to claim 1, characterised in that the accessory is a closure cap (32) having pliable closure plugs (36, 37).

14. Dispensing assembly according to claim 1, characterised in that the accessory is a closure cap (51) whose closure plugs (57, 58) are arranged rotatably with respect to a housing (52) of the closure cap.

15. Dispensing assembly according to claim 1, characterised in that the gradient angle of the lift-off ramps (87) of the retaining segments (85, 86) is within a range of 25° to 33°.

* * * * *